US009030369B2

(12) United States Patent
Sankaran et al.

(10) Patent No.: US 9,030,369 B2
(45) Date of Patent: May 12, 2015

(54) TERMINATIONLESS POWER SPLITTER/COMBINER

(75) Inventors: Swaminathan Sankaran, Plano, TX (US); Nirmal C. Warke, Irving, TX (US); Hassan Ali, Murphy, TX (US); Brad Kramer, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 300 days.

(21) Appl. No.: 13/466,956

(22) Filed: May 8, 2012

(65) Prior Publication Data

US 2013/0300627 A1 Nov. 14, 2013

(51) Int. Cl.

| | |
|---|---|
| ***H01P 5/22*** | (2006.01) |
| ***H01Q 3/26*** | (2006.01) |
| *H01P 5/16* | (2006.01) |

(52) U.S. Cl.

CPC ..... *H01P 5/222* (2013.01); *Y10T 29/49016* (2015.01); *H01Q 3/26* (2013.01); *H01P 5/16* (2013.01)

(58) Field of Classification Search

CPC ..... H01Q 5/16; H01Q 5/222; H01Q 3/26; H01P 5/16; H01P 5/222

USPC ..... 343/700 MS, 850, 853; 333/109, 120, 333/136

See application file for complete search history.

(56) References Cited

U.S. PATENT DOCUMENTS

| | | | | |
|---|---|---|---|---|
| 4,254,386 | A | 3/1981 | Nemit et al. | |
| 4,956,621 | A | 9/1990 | Heckaman et al. | |
| 6,674,410 | B1 | 1/2004 | Davidovitz et al. | |
| 2008/0174501 | A1 * | 7/2008 | Licul et al. | 343/703 |

FOREIGN PATENT DOCUMENTS

| | | |
|---|---|---|
| EP | 1042843 | 11/2002 |

OTHER PUBLICATIONS

U.S. Appl. No. 12/878,484, filed Sep. 9, 2010.
U.S. Appl. No. 13/116,885, filed May 26, 2011.

* cited by examiner

*Primary Examiner* — Robert Karacsony
(74) *Attorney, Agent, or Firm* — John R. Pessetto; Frank D. Cimino

(57) ABSTRACT

An apparatus is provided. First and second hybrid couplers are provided with each having a first port, a second port, a third port, a fourth port and with each being substantially curvilinear. The fourth ports of the first and second hybrid couplers are first and second isolation port that are mutually coupled. The first port of the first hybrid coupler is configured to carry a first portion of a differential signal, and the first port of the second hybrid coupler is configured to carry a second portion of the differential signal.

18 Claims, 11 Drawing Sheets

TERMINATIONLESS POWER SPLITTER/COMBINER

TECHNICAL FIELD

The invention relates generally to power splitters or combiners and, more particularly, to terminationless power splitters or combiners.

BACKGROUND

In radio frequency (RF) applications, it is commonplace to split and/or combine signals, and there are a variety of ways in which this can be accomplished. One example is a Wilkinson splitter/combiner 100, which can be seen in FIG. 1. Typically, a Wilkinson splitter (or combiner) 100 is a 2-to-1 splitter (or combiner) having input port WIN and output ports WOUT1 and WOUT2. The distances D2 and D3 along the outer diameter of the splitter 100 is on the order of one-quarter of the wavelength for the frequency-of-interest, and the distance D1 along the inner diameter of the splitter 100 is on the order of one-half the wavelength for the frequency-of-interest. Additionally, an impedance element (i.e., resistor) 102 is coupled between ports WOUT1 and WOUT2 to allow for isolation and proper impedance matching.

In another alternative approach, a hybrid coupler or rat-race 200 (as shown in FIG. 2) can be employed. As shown, this coupler 200 is generally curvilinear (i.e. circular) with an inner diameter (which can, for example, be one and one-half the wavelength of the frequency—of interest). This coupler 200 has an input port RIN and output port ROUT1 and ROUT2 (which are capable of outputting signals outputting signals at approximately one-half the input power). Additionally, there is an isolation port RISO that is terminated with an impedance element (i.e., resistor) 202.

Each of these different approaches can be adequate under appropriate conditions (i.e., <10 GHz); however, for high speed applications (i.e. terahertz or millimeter wave), these approaches may not be adequate. In particular, the physical terminations (i.e., impedance elements 102 and 202) may be prohibitive in terms of both cost and size. Therefore, there is a need for an improved combiner/splitter.

Some examples of conventional systems are: U.S. Pat. Nos. 4,254,386; 4,956,621; 6,674,410; and European Patent No. EP1042843.

SUMMARY

The present invention, accordingly, provides an apparatus. The apparatus comprises a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear; and a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled.

In accordance with the present invention, the apparatus further comprises: a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear; and a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled.

In accordance with the present invention, the first, second, third, and fourth couplers are symmetrically arranged.

In accordance with the present invention, the apparatus further comprises: a substrate; and a metallization layer formed over the substrate, wherein the metallization layer is pattered to form the first, second, third, and fourth hybrid couplers.

In accordance with the present invention, the third and fourth ports of the first hybrid coupler are coupled to a first antenna, and wherein the third and fourth ports of the second hybrid coupler are coupled to a second antenna, and wherein the third and fourth ports of the third hybrid coupler are coupled to a third antenna, and wherein the third and fourth ports of the fourth hybrid coupler are coupled to a fourth antenna.

In accordance with the present invention, the metallization layer further comprises a first metallization layer, and wherein the first, second, third, and fourth antennas further comprises: a first set of vias formed over the first metallization layer, wherein each via from the first set of vias is electrically coupled to at least one of the second ports from the first, second, third, and fourth hybrid couplers; a second set of vias formed over the first metallization layer, wherein each via from the second set of vias is electrically coupled to at least one of the third ports from the first, second, third, and fourth hybrid couplers; and a second metallization layer formed over the first and second sets of vias and patterned to form portions of the first, second, third, and fourth antennas.

In accordance with the present invention, the apparatus further comprises: a third set of vias formed between the first metallization layer and the substrate, wherein each via from the third set of vias is electrically coupled to at least one of the fourth ports from the first, second, third, and fourth hybrid couplers; and a third metallization layer formed between the substrate and the first metallization layer, wherein the third metallization layer is patterned such that the mutual coupling between the first and second hybrid couplers and the mutual coupling between the third and fourth hybrid couplers are electrical couplings.

In accordance with the present invention, the apparatus further comprises a third metallization layer formed between the first metallization layer and the substrate.

In accordance with the present invention, a method is provided. The method comprises forming a metallization layer formed over a substrate; and patterning the metallization layer to form: a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear; a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled; a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear; and a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled.

In accordance with the present invention, the metallization layer further comprises a first metallization layer, and wherein the method further comprises forming first, second, third, and fourth antennas by: forming a first set of vias over the first metallization layer, wherein each via from the first set of vias is electrically coupled to at least one of the second ports from the first, second, third, and fourth hybrid couplers; forming a second set of vias over the first metallization layer, wherein each via from the second set of vias is electrically coupled to at least one of the third ports from the first, second, third, and fourth hybrid couplers; and forming a second metallization layer over the first and second sets of vias and patterned to form portions of the first, second, third, and fourth antennas.

In accordance with the present invention, the method further comprises: forming a third set of vias between the first metallization layer and the substrate, wherein each via from the third set of vias is electrically coupled to at least one of the fourth ports from the first, second, third, and fourth hybrid couplers; and forming a third metallization layer between the substrate and the first metallization layer, wherein the third metallization layer is patterned such that the mutual coupling between the first and second hybrid couplers and the mutual coupling between the third and fourth hybrid couplers are electrical couplings.

In accordance with the present invention, the method further comprises forming a third metallization layer between the first metallization layer and the substrate.

In accordance with the present invention, an apparatus comprising: an integrated circuit (IC); and an antenna package that is secured to the IC, wherein the antennal package includes: a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear, and wherein the first port of the first hybrid coupled is coupled to the IC; a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled, and wherein the first port of the second hybrid coupled is coupled to the IC; a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear, and wherein the first port of the third hybrid coupled is coupled to the IC; a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled, and wherein the first port of the fourth hybrid coupled is coupled to the IC; a first antenna that is coupled to the third and fourth ports of the first hybrid coupler; a second antenna that is coupled to the third and fourth ports of the second hybrid coupler; a third antenna that is coupled to the third and fourth ports of the third hybrid coupler; and a fourth antenna that is coupled to the third and fourth ports of the fourth hybrid coupler.

In accordance with the present invention, the antenna package further comprises: a substrate; a first metallization layer formed over the substrate; a second metallization layer formed over the first metallization layer, wherein the second metallization layer is pattered to form the first, second, third, and fourth hybrid couplers; a first set of vias formed over the second metallization layer, wherein each via from the first set of vias is electrically coupled to at least one of the second ports from the first, second, third, and fourth hybrid couplers; a second set of vias formed over the second metallization layer, wherein each via from the second set of vias is electrically coupled to at least one of the third ports from the first, second, third, and fourth hybrid couplers; and a third metallization layer formed over the first and second sets of vias and patterned to form portions of the first, second, third, and fourth antennas.

In accordance with the present invention, the antenna package further comprises a high impedance surface (HIS) that substantially surrounds the first, second, third, and fourth antennas.

In accordance with the present invention, the antenna package further comprises: a substrate; a first metallization layer formed over the substrate; a first set of vias formed over the first metallization layer; a second metallization layer formed over the first set of vias, wherein the second metallization layer is pattered to form the first, second, third, and fourth hybrid couplers, and wherein the first metallization layer is patterned to form electrical coupling between first and second isolation ports and the third and fourth isolation ports, and wherein each via from the first set of vias is electrical coupled to at least one of the first, second, third, and fourth isolation ports; a second set of vias formed over the second metallization layer, wherein each via from the second set of vias is electrically coupled to at least one of the second ports from the first, second, third, and fourth hybrid couplers; a third set of vias formed over the second metallization layer, wherein each via from the third set of vias is electrically coupled to at least one of the third ports from the first, second, third, and fourth hybrid couplers; and a third metallization layer formed over the second and third sets of vias and patterned to form portions of the first, second, third, and fourth antennas.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
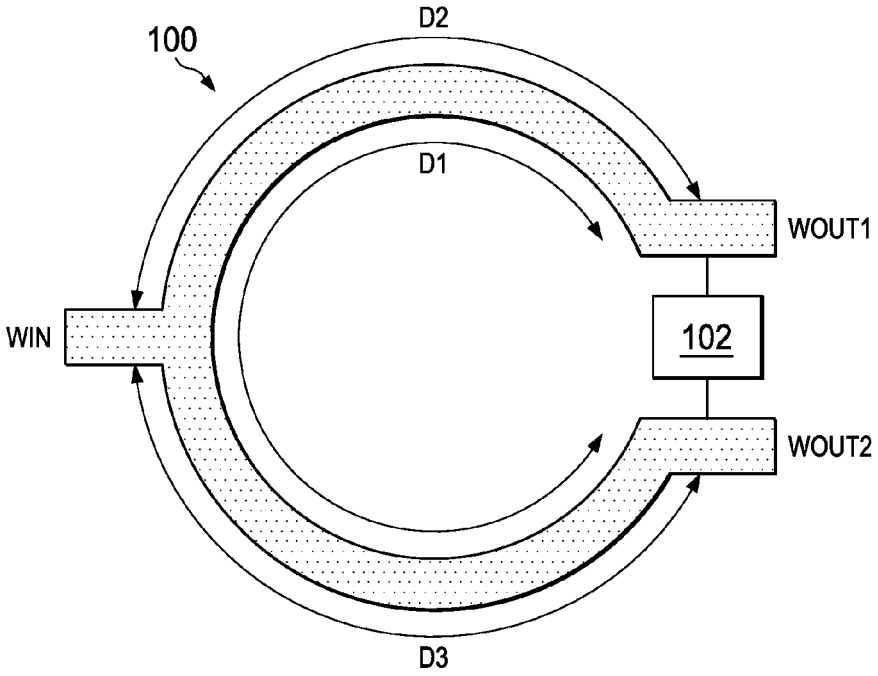
FIG. 1 (PRIOR ART)
FIG. 1 is a diagram of an example of a convention Wilkinson splitter/combiner.
Figure 2:
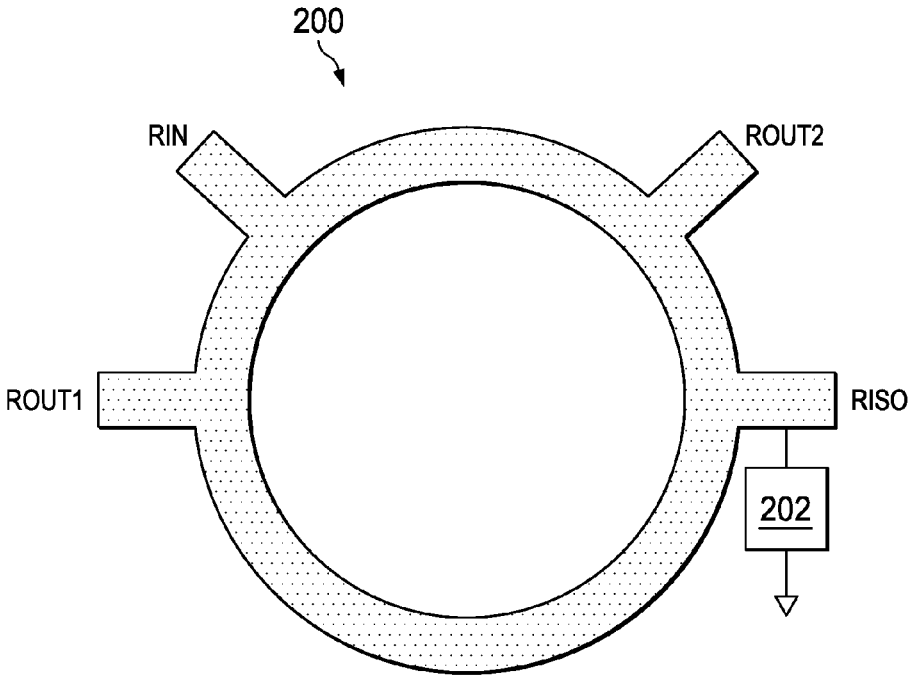
FIG. 2 (PRIOR ART)
FIG. 2 is a diagram of an example of a conventional hybrid coupler.

Refer now to the drawings wherein depicted elements are, for the sake of clarity, not necessarily shown to scale and wherein like or similar elements are designated by the same reference numeral through the several views.

Figure 3:
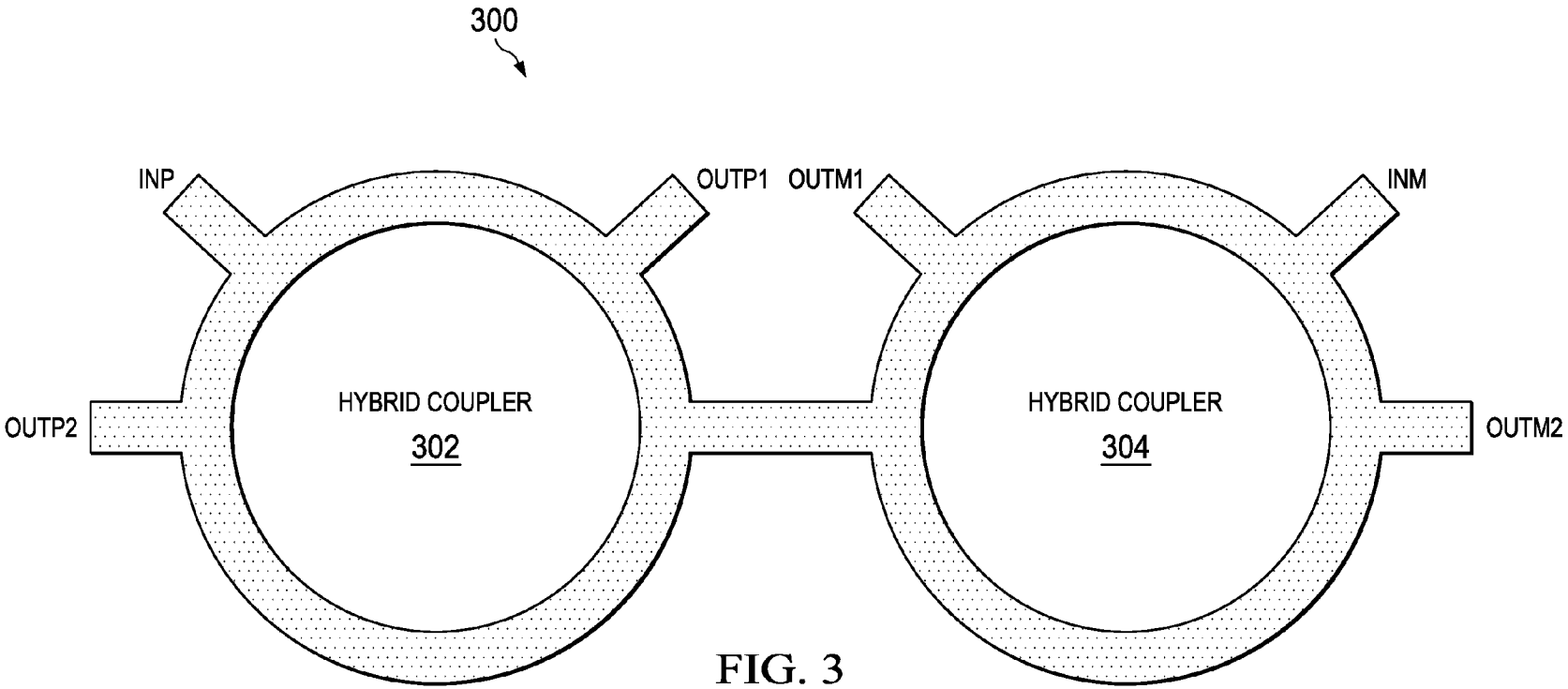
FIG. 3 is a diagram of an example of a hybrid coupler in accordance with the present invention.

Turning to FIG. 3, an example of a differential coupler 300 in accordance with the present invention can be seen. As shown, this differential coupler 300 is generally comprised of hybrid couplers 302 and 304 with a mutual coupling between their respective isolation ports. This mutual coupling can be accomplished electrically coupling the isolation ports (i.e., via a wire or trace) or by virtue of a symmetric layout. By having the mutual coupling, termination is achieved by "zero action" where each of the hybrid couplers 302 and 304 mutually terminate one another. This allows a full power differential to be carried (i.e., input if coupler 300 is a splitter and output if coupler 300 is a combiner) by terminals INM and INP and one-half power signals carried by terminals OUTM1, OUTM2, OUTP1, and OUTP2.

Figure 4:
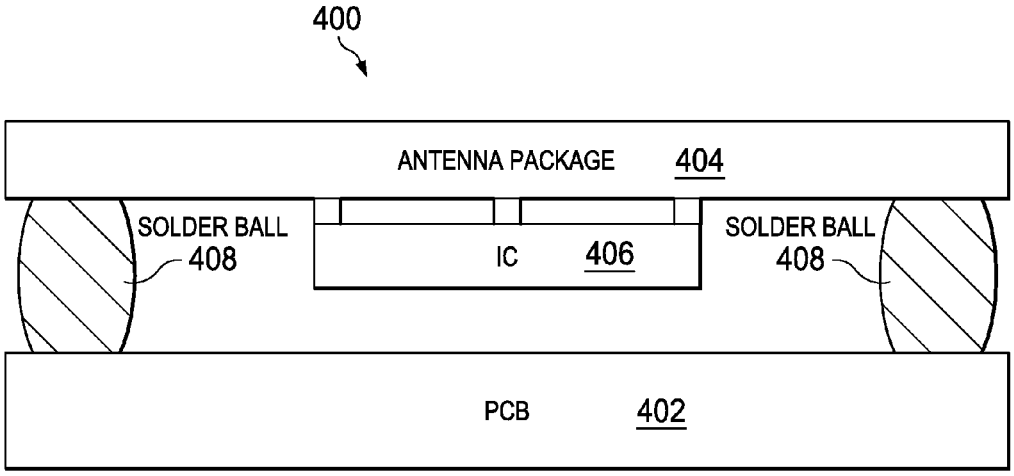
FIG. 4 is a diagram of an example of a system implementing the hybrid coupler of FIG. 2.
Figure 5:
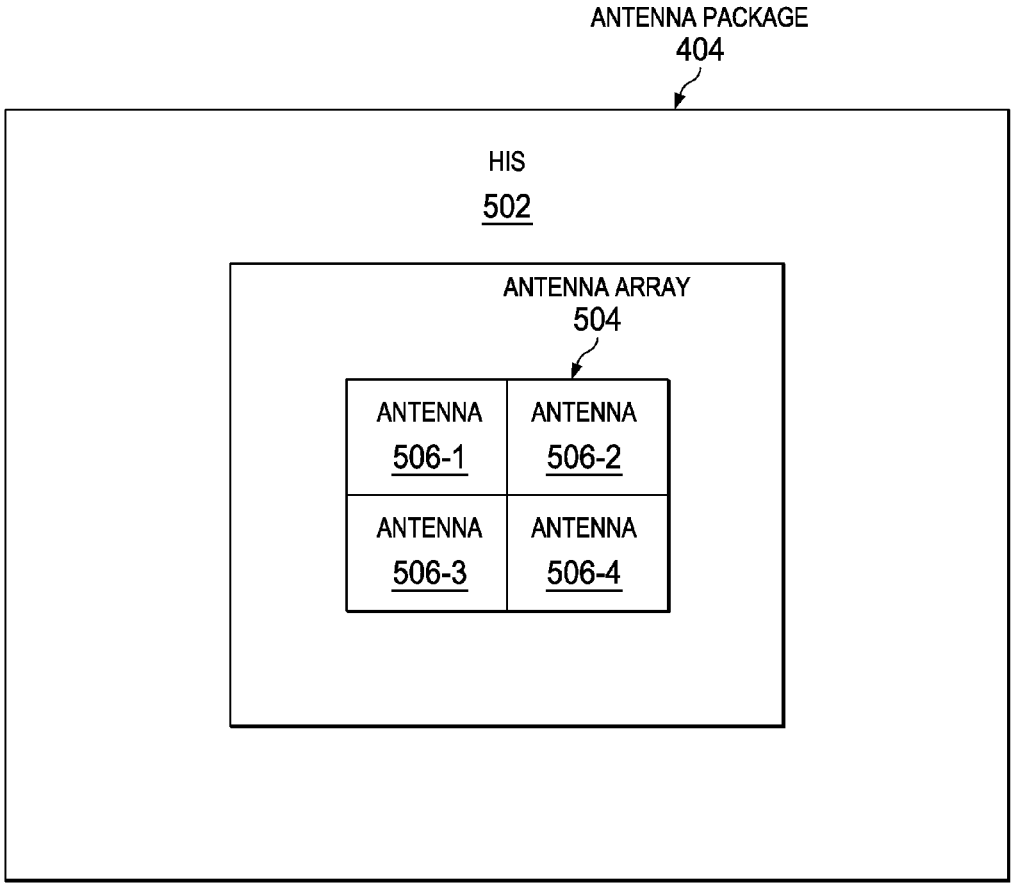
FIG. 5 is a plan view of an example of the antenna package of FIG. 4
Figure 6:
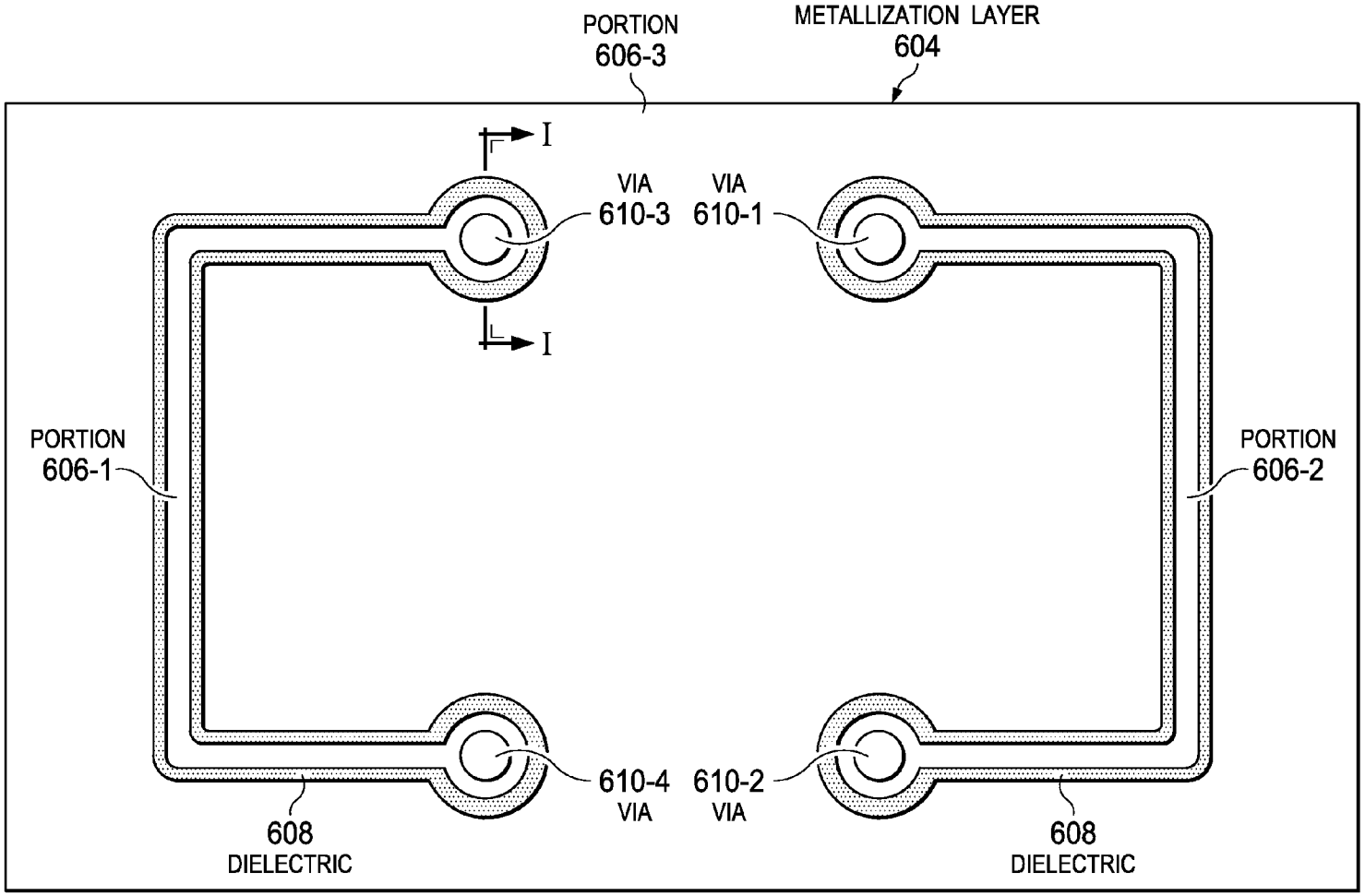
FIGS. 6 and 16 are a plan view of examples of a metallization layer of the antenna package of FIG. 4.
Figure 7:
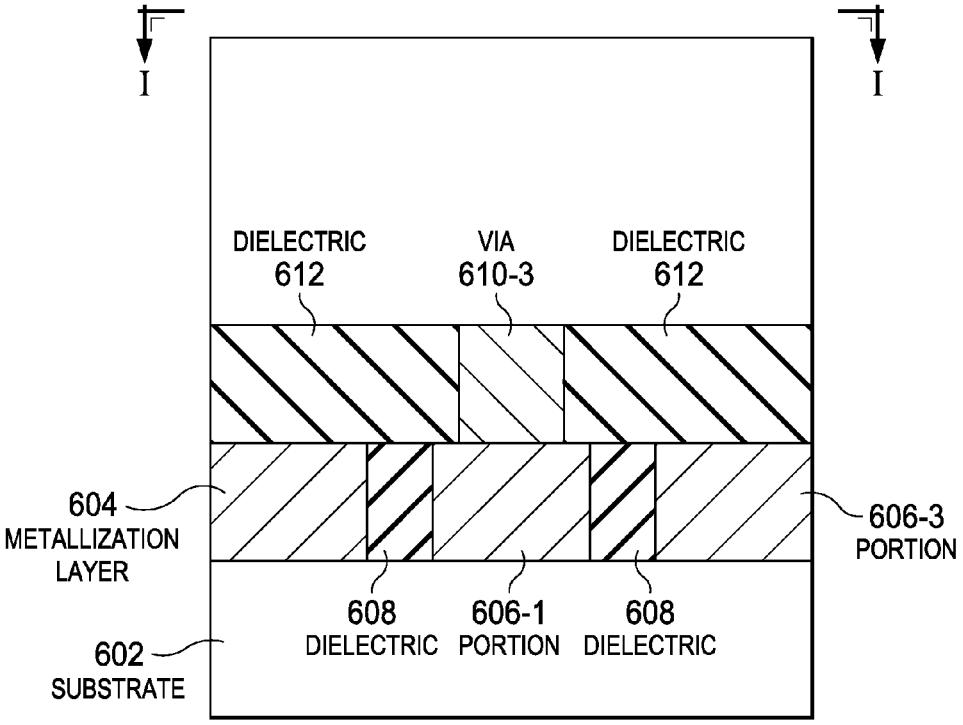
FIG. 7 is a cross-sectional view of the antenna package along section line I-I.
Figure 9:
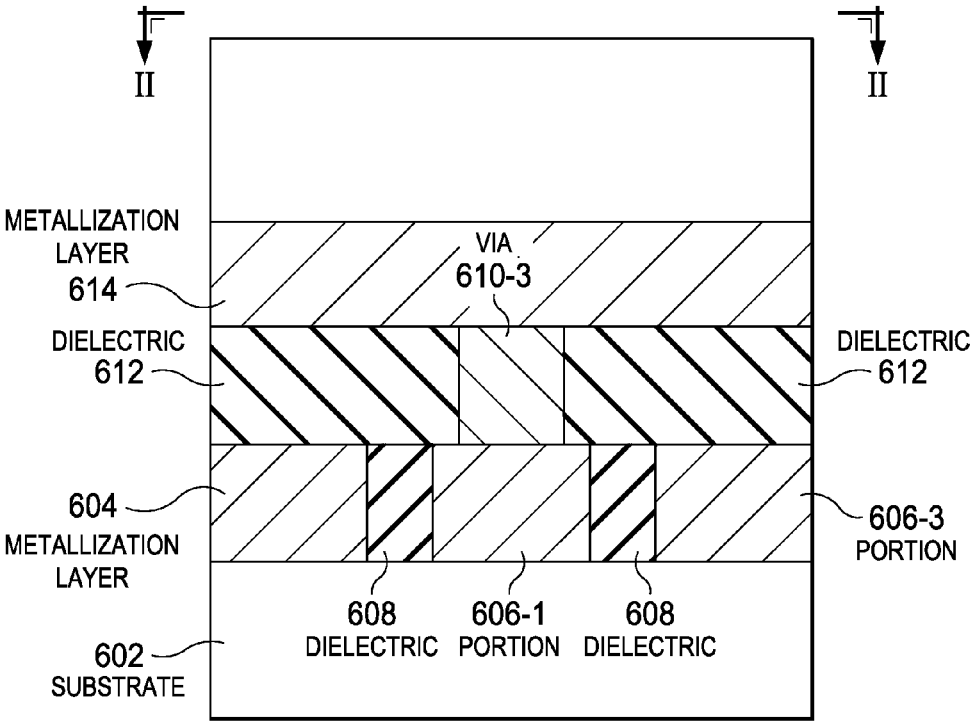
FIGS. 9-11 are cross-sectional views of the antenna package along section line II-II, III-III, and IV-IV, respectively.
Figure 8:
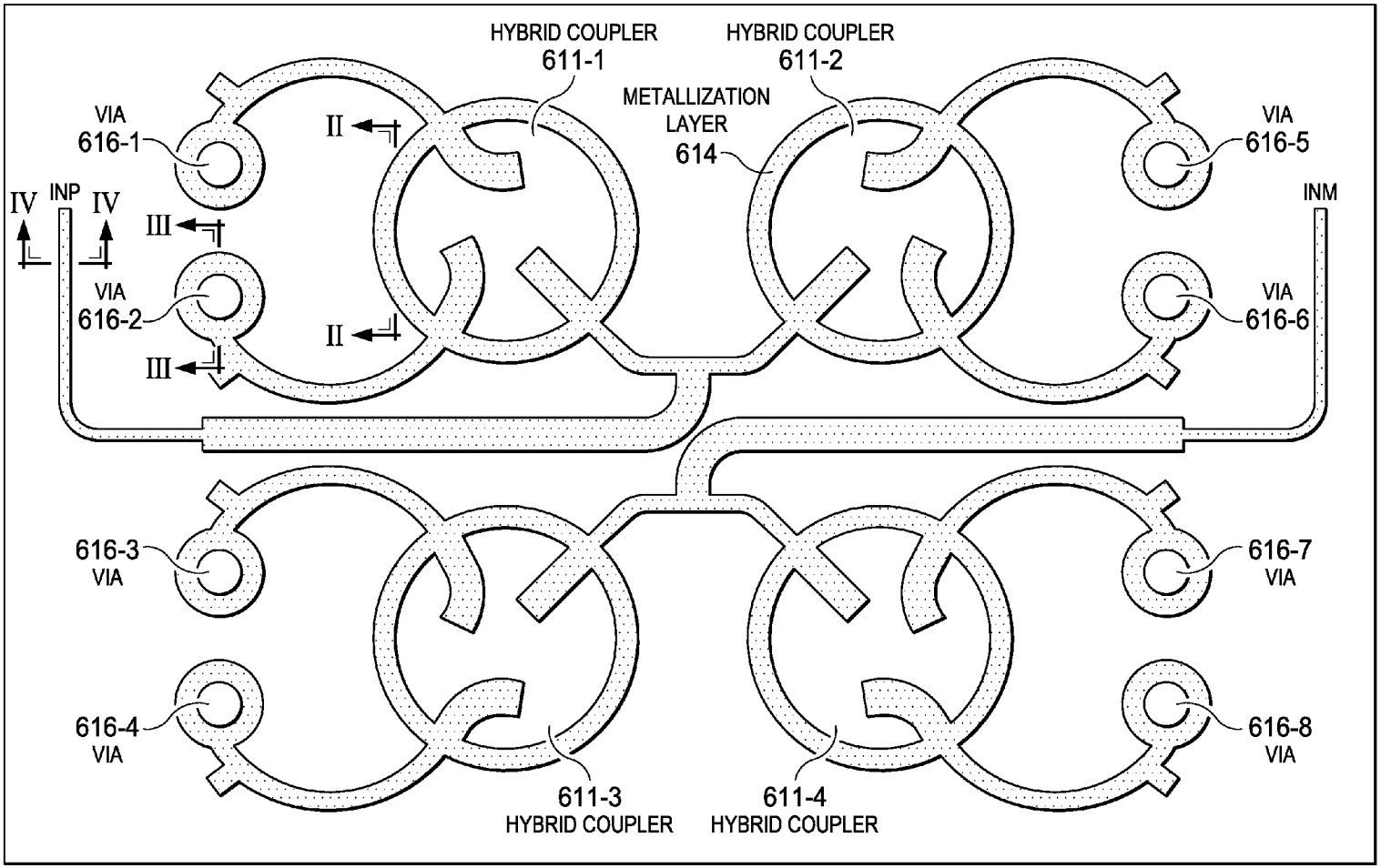
FIG. 8 is a plan view of an example of a metallization layer of the antenna package of FIG. 4.
Figure 10:
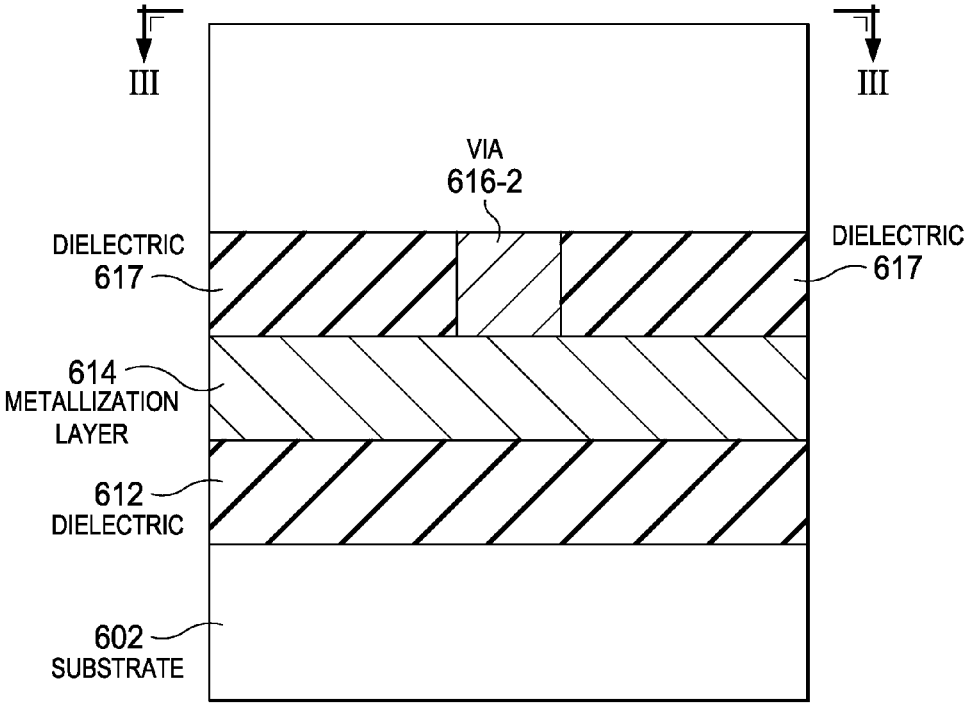
Figure 11:
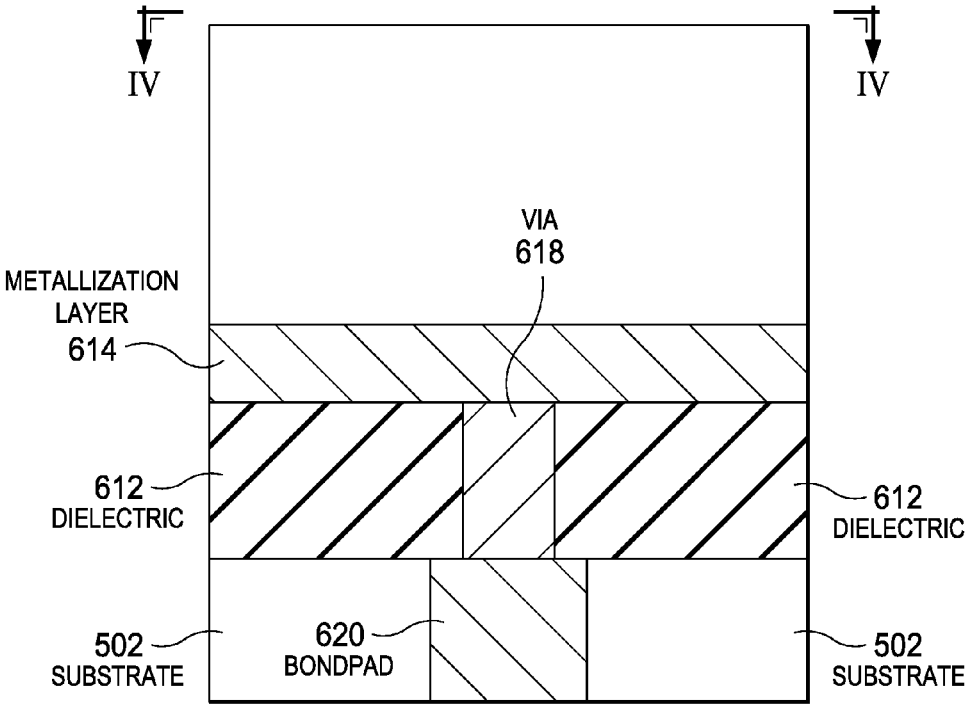
Figure 12:
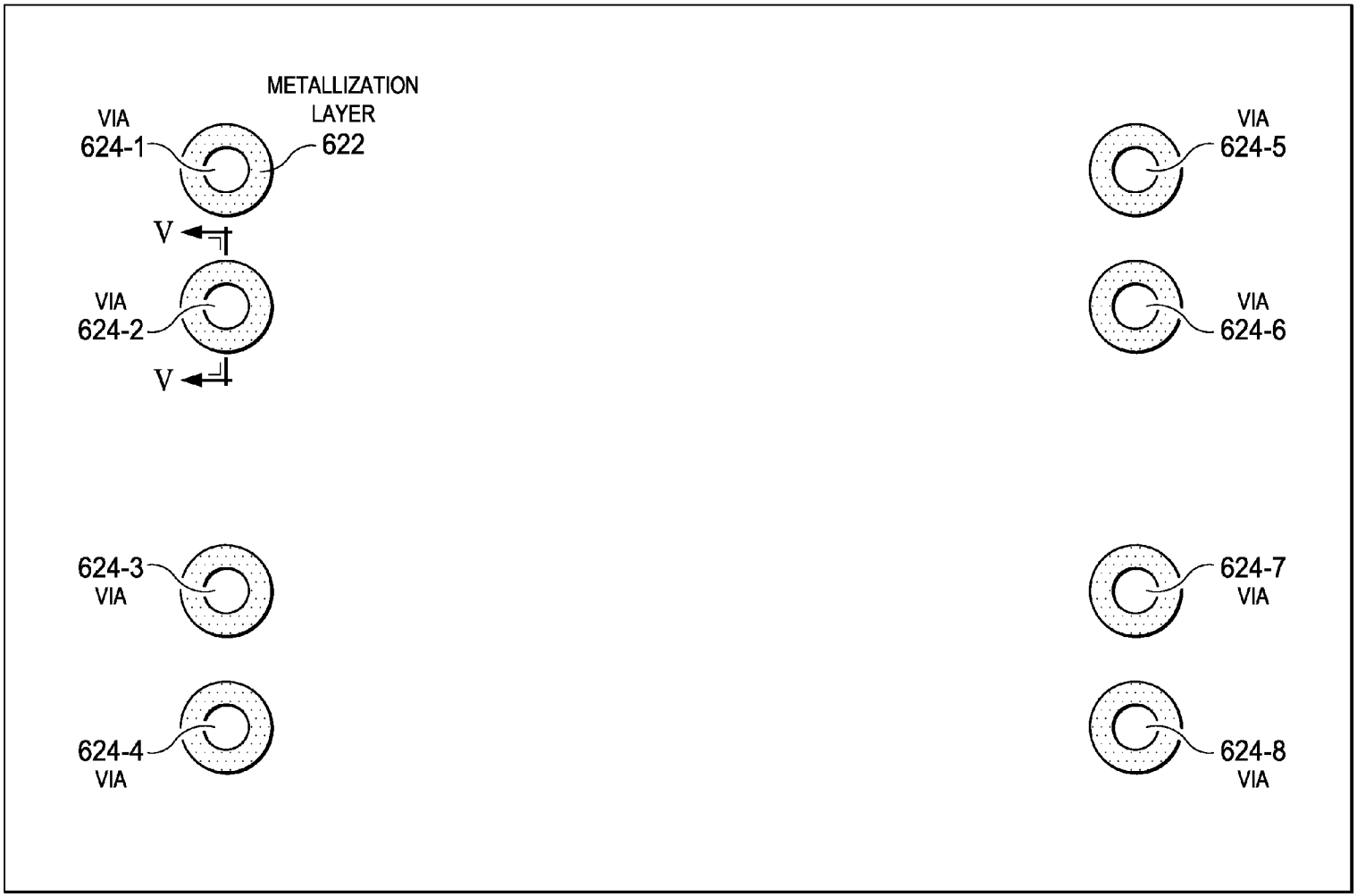
FIG. 12 is a plan view of an example of a metallization layer of the antenna package of FIG. 4.
Figure 13:
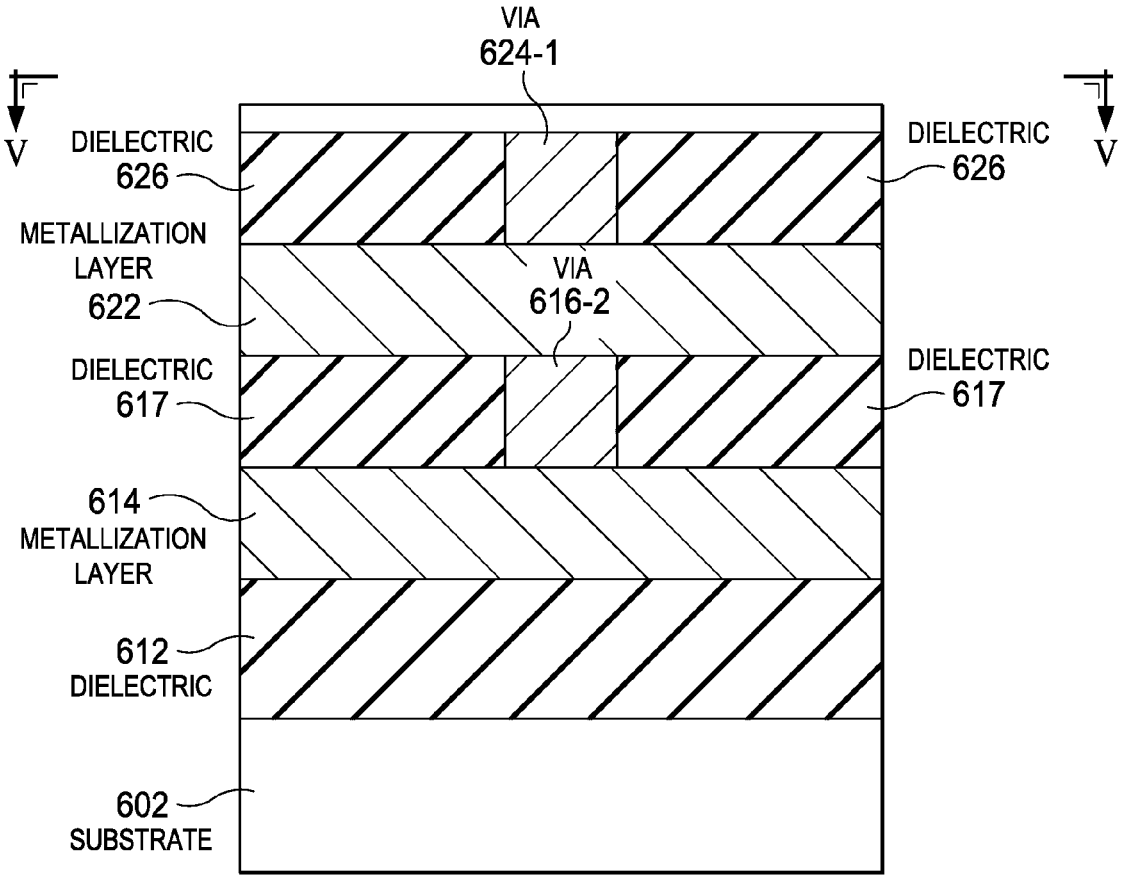
FIG. 13 is a cross-sectional view of the antenna package along section line V-V.
Figure 14:
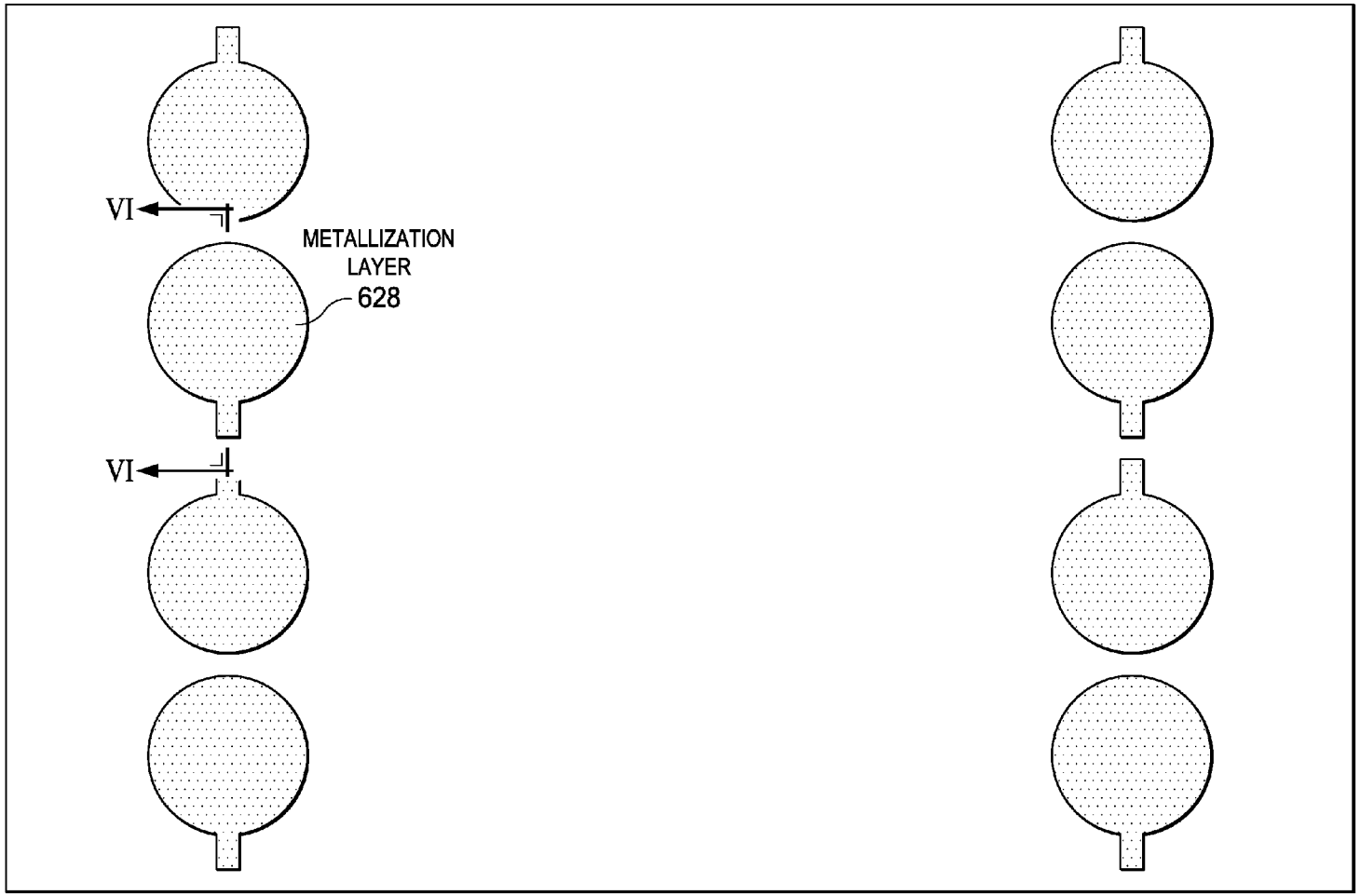
FIG. 14 is a plan view of an example of a metallization layer of the antenna package of FIG. 4.
Figure 15:
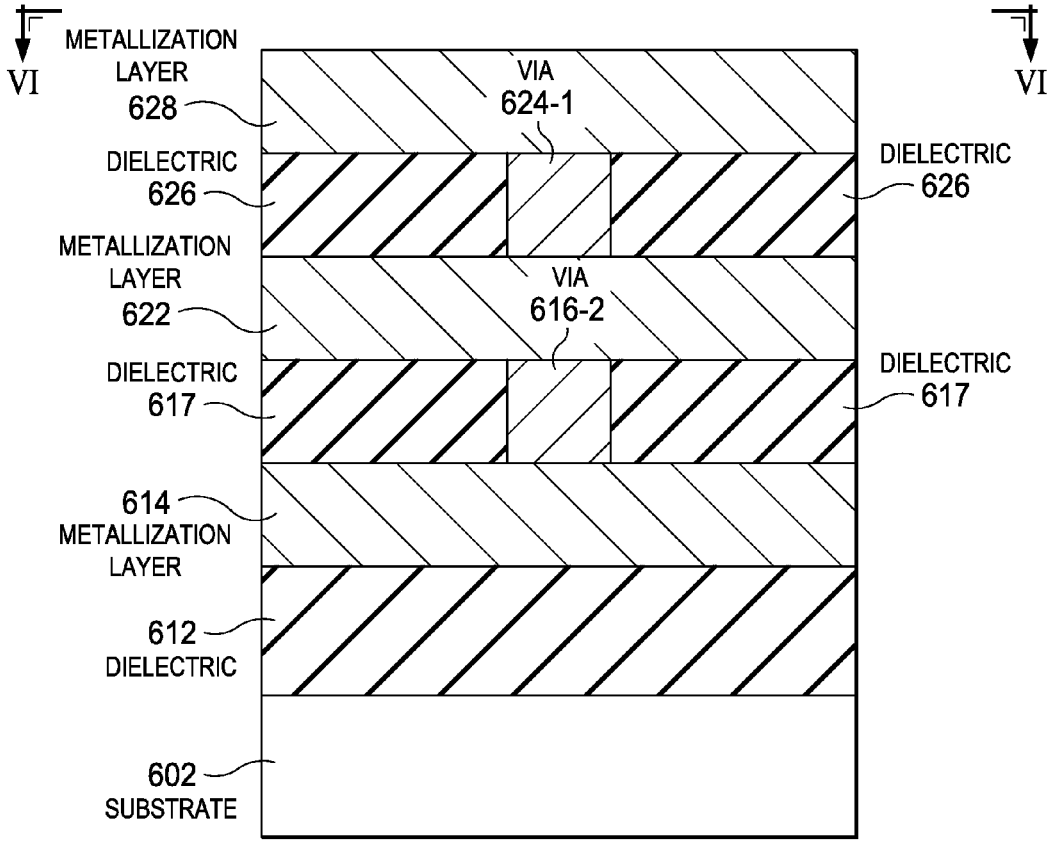
FIG. 15 is a cross-sectional view of the antenna package along section line VI-VI.

In FIGS. 4 and 5, an example implementation for the coupler 300 can be seen. In this implementation, the coupler 300 is employs as part of the antenna package 404 of the terahertz or millimeter transmitter (which can transmit or receive RF signals in the range of 0.1 THz to 10 THz). The antenna package 202 (which, as shown, is coupled to printed circuit board or PCB 402 through solder balls (i.e., 408) to allow other integrated circuits (ICs) secured to the PCB 402 to communicate with IC 406. IC 406 (which is secured to antenna package 406) includes an on-chip terahertz or millimeter wave transmitter is electrically coupled to a feed network (of which the coupler 300 is a part) and antennas. An example of a terahertz transmitter can be seen in U.S. patent application Ser. No. 12/878,484, which is entitled "Terahertz Phased Array System," and which is incorporated by reference herein for all purposes.

Typically, the antenna package 404, itself, is a multiplayer PCB or IC where the feed network and antennas are built in layers. As shown in FIG. 5, there can, for example, be antenna array 504 located substantially at the center of the antenna package 404. This antenna array 504 can be surrounded by a high impedance surface (HIS) to improve transmission and reception characteristics, and an example of an HIS can be seen in U.S. patent application Ser. No. 13/116,885, which in entitled "High Impedance Surface," and which is incorporated by reference herein for all purposes. As shown, the antenna array 504 is comprised of four antennas 506-1 to 506-4 arranged in a 2×2; other array densities (i.e., number of antennas) may also be employed.

Now, turning to FIGS. 4-15, an example of the antenna array 404 can be seen in greater detail. In this example, a 4-to-1 coupler is employed to coupled differential feed terminals (which are generally coupled to IC 406) to antennas 506-1 to 506-2. As shown, there is a metallization layer 604 (which can, for example, be formed of aluminum or copper) formed over a substrate 602, which is patterned for form portions 606-1 and 606-2 that can form traces for electrical coupling between isolation ports for two couplers (i.e., 300). The portions 606-1 and 606-2 can be coupled to the isolation ports through vias 610-1 to 610-4 (which can, for example, be formed of tungsten) that can be formed in openings of dielectric layer 612 (which can, for example, be silicon dioxide). Over the dielectric layer 612 (and vias 610-1 and 610-2), another metallization layer 614 (which can, for example, be formed of aluminum or copper) may be formed. This metallization layer 614 can be pattered to form hybrid couplers 611-1 to 611-4 that are arranged symmetrically with the differential feed terminals INM and INP being opposite of one another. As shown in this example, there is mutually coupling between the isolation ports of couplers 611-1 and 611-3 and between the isolation ports of couplers 611-2 and 611-4. Also as shown, one port for each of hybrid couplers 611-1 and 611-2 can carry one portion of a differential input signal, while the other portion of the differential input signal can be carried by a port from each of couplers 611-3 and 611-4.

Figure 16:
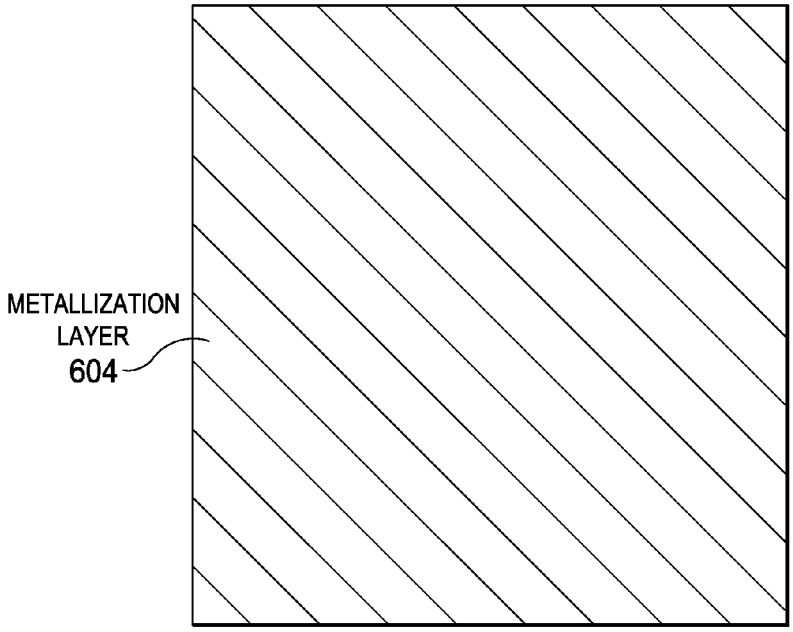

Each of these hybrid couplers 611-1 to 611-4 can then be coupled to antennas 506-1 to 506-4, respectively. The antennas 506-1 to 506-4 can be formed by electrically coupling vias 616-1 to 616-8 to terminals of hybrid couplers 611-1 to 611-4. Similar to other vias (i.e., 610-3), these vias 616-1 to 616-8 can formed of tungsten within openings of dielectric layer 617 (which can, for example, be silicon dioxide). Formed over dielectric layer 617, there can be metallization layer 622 that can be patterned to form discs that are substantially coaxial with vias 616-1 to 616-8. Another set of vias 624-1 to 624-8 can be formed in dielectric layer 626, and can be substantially coaxial with vias 616-1 to 616-8. Another metallization layer 628 (which may be formed aluminum of copper) can then be formed over dielectric layer 626 and can be pattered to form discs that are eccentrically aligned with 624-1 to 624-8. These discs, in contrast to those of metallization layer 628 had nubs or fingers that are substantially aligned (i.e., aligned along two parallel lines). Alternatively, as shown in FIG. 16, metallization layer 604 may be comprised of an unpatterned sheet and vias 610-1 to 610-4 may be omitted.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear; and a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled;

a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear; and a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled.

2. The apparatus of claim 1, wherein the first, second, third, and fourth couplers are symmetrically arranged.

3. The apparatus of claim 2, wherein the apparatus further comprises:

a substrate; and a metallization layer formed over the substrate, wherein the metallization layer is patterned to form the first, second, third, and fourth hybrid couplers.

4. The apparatus of claim 3, wherein the third and fourth ports of the first hybrid coupler are coupled to a first antenna, and wherein the third and fourth ports of the second hybrid coupler are coupled to a second antenna, and wherein the third and fourth ports of the third hybrid coupler are coupled to a third antenna, and wherein the third and fourth ports of the fourth hybrid coupler are coupled to a fourth antenna.

5. The apparatus of claim 4, wherein the metallization layer further comprises a first metallization layer, and wherein the first, second, third, and fourth antennas further comprises:

a first set of vias formed over the first metallization layer, wherein each via from the first set of vias is electrically coupled to at least one of the second ports from the first, second, third, and fourth hybrid couplers;

a second set of vias formed over the first metallization layer, wherein each via from the second set of vias is electrically coupled to at least one of the third ports from the first, second, third, and fourth hybrid couplers; and a second metallization layer formed over the first and second sets of vias and patterned to form portions of the first, second, third, and fourth antennas.

6. The apparatus of claim 5, wherein the apparatus further comprises:

a third set of vias formed between the first metallization layer and the substrate, wherein each via from the third set of vias is electrically coupled to at least one of the fourth ports from the first, second, third, and fourth hybrid couplers; and a third metallization layer formed between the substrate and the first metallization layer, wherein the third metallization layer is patterned such that the mutual coupling between the first and second hybrid couplers and the mutual coupling between the third and fourth hybrid couplers are electrical couplings.

7. The apparatus of claim 5, wherein the apparatus further comprises a third metallization layer formed between the first metallization layer and the substrate.

8. A method comprising:

forming a metallization layer formed over a substrate; and patterning the metallization layer to form:

a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear;

a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled;

a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear; and a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled.

9. The method of claim 8, wherein the first, second, third, and fourth couplers are symmetrically arranged.

10. The method of claim 9, wherein the metallization layer further comprises a first metallization layer, and wherein the method further comprises forming first, second, third, and fourth antennas by:

forming a first set of vias over the first metallization layer, wherein each via from the first set of vias is electrically coupled to at least one of the second ports from the first, second, third, and fourth hybrid couplers;

forming a second set of vias over the first metallization layer, wherein each via from the second set of vias is electrically coupled to at least one of the third ports from the first, second, third, and fourth hybrid couplers; and forming a second metallization layer over the first and second sets of vias and patterned to form portions of the first, second, third, and fourth antennas.

11. The method of claim 10, wherein the method further comprises:

forming a third set of vias between the first metallization layer and the substrate, wherein each via from the third set of vias is electrically coupled to at least one of the fourth ports from the first, second, third, and fourth hybrid couplers; and forming a third metallization layer between the substrate and the first metallization layer, wherein the third metallization layer is patterned such that the mutual coupling between the first and second hybrid couplers and the mutual coupling between the third and fourth hybrid couplers are electrical couplings.

12. The method of claim 10, wherein the method further comprises forming a third metallization layer between the first metallization layer and the substrate.

13. An apparatus comprising:

an integrated circuit (IC); and an antenna package that is secured to the IC, wherein the antennal package includes:

a first hybrid coupler having a first port, a second port, a third port, and a fourth port, wherein the fourth port of the first hybrid coupler is a first isolation port, and wherein the first port of the first hybrid coupler is configured to carry a first portion of a differential signal, and wherein the first hybrid coupler is substantially curvilinear, and wherein the first port of the first hybrid coupled is coupled to the IC;

a second hybrid coupler having a first port, a second port, a third port, and a fourth port, wherein the fourth port of the second hybrid coupler is a second isolation port, and wherein the first port of the second hybrid coupler is configured to carry a second portion of the differential signal, and wherein the second hybrid coupler is substantially curvilinear, and wherein the first and second isolation ports are mutually coupled, and wherein the first port of the second hybrid coupled is coupled to the IC;

a third hybrid coupler having a first port, a second port, a third port, and a fourth port, wherein the fourth port of the third hybrid coupler is a third isolation port, and wherein the first port of the third hybrid coupler is configured to carry the first portion of the differential signal, and wherein the third hybrid coupler is substantially curvilinear, and wherein the first port of the third hybrid coupled is coupled to the IC;

a fourth hybrid coupler having a first port, a second port, a third port, and a fourth port, wherein the fourth port of the fourth hybrid coupler is a fourth isolation port, and wherein the first port of the fourth hybrid coupler is configured to carry the second portion of the differential signal, and wherein the fourth hybrid coupler is substantially curvilinear, and wherein the third and fourth isolation ports are mutually coupled, and wherein the first port of the fourth hybrid coupled is coupled to the IC;

a first antenna that is coupled to the third and fourth ports of the first hybrid coupler;

a second antenna that is coupled to the third and fourth ports of the second hybrid coupler;

a third antenna that is coupled to the third and fourth ports of the third hybrid coupler; and a fourth antenna that is coupled to the third and fourth ports of the fourth hybrid coupler.

14. The apparatus of claim 13, wherein the first, second, third, and fourth couplers are symmetrically arranged.

15. The apparatus of claim 14, wherein the antenna package further comprises:

a substrate;

a first metallization layer formed over the substrate;

a second metallization layer formed over the first metallization layer, wherein the second metallization layer is pattered to form the first, second, third, and fourth hybrid couplers;

a first set of vias formed over the second metallization layer, wherein each via from the first set of vias is electrically coupled to at least one of the second ports from the first, second, third, and fourth hybrid couplers;

a second set of vias formed over the second metallization layer, wherein each via from the second set of vias is electrically coupled to at least one of the third ports from the first, second, third, and fourth hybrid couplers; and a third metallization layer formed over the first and second sets of vias and patterned to form portions of the first, second, third, and fourth antennas.

16. The apparatus of claim 15, wherein the antenna package further comprises a high impedance surface (HIS) that substantially surrounds the first, second, third, and fourth antennas.

17. The apparatus of claim 14, wherein the antenna package further comprises:

a substrate;

a first metallization layer formed over the substrate;

a first set of vias formed over the first metallization layer;

a second metallization layer formed over the first set of vias, wherein the second metallization layer is pattered to form the first, second, third, and fourth hybrid couplers, and wherein the first metallization layer is patterned to form electrical coupling between first and second isolation ports and the third and fourth isolation ports, and wherein each via from the firs set of vias is electrical coupled to at least one of the first, second, third, and fourth isolation ports;

a second set of vias formed over the second metallization layer, wherein each via from the second set of vias is electrically coupled to at least one of the second ports from the first, second, third, and fourth hybrid couplers;

a third set of vias formed over the second metallization layer, wherein each via from the third set of vias is electrically coupled to at least one of the third ports from the first, second, third, and fourth hybrid couplers; and a third metallization layer formed over the second and third sets of vias and patterned to form portions of the first, second, third, and fourth antennas.

18. The apparatus of claim 17, wherein the antenna package further comprises an HIS that substantially surrounds the first, second, third, and fourth antennas.

* * * * *